US005326004A

United States Patent [19]

Daily, Jr.

[11] Patent Number: 5,326,004

[45] Date of Patent: Jul. 5, 1994

[54] NECKTIE POSITIONING DEVICE

[76] Inventor: Ralph D. Daily, Jr., 63 Maple Ave., Unionville, Conn. 06085

[21] Appl. No.: 959,809

[22] Filed: Oct. 13, 1992

[51] Int. Cl.[5] ..... A41H 1/00; A41H 21/00; B43L 7/00

[52] U.S. Cl. ..... 223/111; 33/501; 33/613; 2/144; 2/145

[58] Field of Search ..... 2/52, 145, 150, 152 R, 2/153, 146, 101, 300, 319, 325, 338; 33/501, 653, 613, 832, 833; 84/471 SR, 485 SR; 223/111, 116; 235/79.5, 84; 24/580, 585, 49 R

[56] References Cited

U.S. PATENT DOCUMENTS

| | | | |
|---|---|---|---|
| 728,861 | 5/1903 | Carman | 33/832 X |
| 2,148,154 | 2/1939 | Garfinkle | 2/146 |
| 2,499,260 | 2/1950 | Rhein | 2/146 |
| 2,924,015 | 2/1960 | Gurries | 33/833 X |
| 3,269,618 | 8/1966 | Humalainen | 2/325 |
| 3,271,780 | 9/1966 | De Jean | 2/146 |
| 3,321,773 | 5/1967 | Orciuch | 2/146 |
| 3,510,032 | 5/1970 | Carver | 223/111 |
| 4,059,906 | 11/1977 | Kurtz | 33/180 R |
| 4,845,857 | 7/1989 | Klosterman | 33/613 |
| 4,856,115 | 8/1989 | Knapp | 2/155 |
| 4,875,239 | 10/1989 | Patterson, Jr. | 2/152 R |
| 5,003,636 | 4/1991 | Marostica | 2/145 |
| 5,088,118 | 2/1992 | Whiteley | 2/150 X |

*Primary Examiner*—Clifford D. Crowder
*Assistant Examiner*—Jeanette E. Chapman

[57] ABSTRACT

A necktie positioning device having an elongated body member which engages a sliding member which is joined to an arm. The arm projects outwardly from the body member and is adapted for insertion in a belt loop, and, when so inserted, and when the inner flap of a tie is held against a preselected marking on the body member, the device determines the correct length of tie prior to tying.

3 Claims, 5 Drawing Sheets

NECKTIE POSITIONING DEVICE

BACKGROUND OF THE INVENTION

This invention relates to men's neckties and more particularly to the everyday task of putting on a tie.

As is known, ties are worn by well dressed men everywhere as part of their business attire. Ties are also a large part of men's casual attire.

It is important for a man's tie to look presentable. Aside from the style, the most noticeable thing about a tie is its length. A tie that is too short or too long is considered sloppy dressing. In fact, the optimum arrangement is to have the tip of the outer flap (the visible portion of the tie) just touch the top of the belt buckle at the waistline.

Unfortunately, it can often be difficult to estimate the correct length of a tie in the morning (when a man may not be fully awake!) and guesswork is usually involved. The man only knows if he guessed correctly at the length of his tie after he has finished tying it. If it is incorrect then he must either accept a poor appearance for that day or he must start over, which wastes time and raises his frustration level.

The prior art shows many Pretied Neckties of the types shown in U.S. Pat. No. 4,875,239 to Patterson and U.S. Pat. No. 4,856,115 to Knapp. Although these neckties may give the correct length of tie they are often undesirable because many men are reluctant to wear anything other than a traditional necktie.

Another concept, which is indicated by U.S. Pat. No. 5,003,636 to Marostica, actually requires the user to sever the necktie to employ the device. Not only is severing one's tie a frightening proposition, but it would be somewhat costly and time consuming to equip each one of a user's ties with such a device.

U.S. Pat. No. 4,059,906 to Kurtz describes a tie locating device which comprises first and second elongated members which are slidably attached and relatively movable along a longitudinal path.

This device is rather unreliable in providing for the correct length of tie because when both hands are holding the tie ends onto the device (as is required by the device), it is quite difficult to know if the tie is evenly taut. If the tie is not evenly taut then the device will not function correctly and an unsatisfactory appearance will be the result.

It is an object of the present invention to provide an easy to use device which can quickly and accurately provide a man with the proper length of tie before he ties it.

It is another object to provide a device which will work adequately for most of a user's ties without requiring any modifications whatsoever to the ties.

It is still another object to provide such a device which can be manufactured and sold at an extremely affordable price.

SUMMARY OF THE INVENTION

It has now been found that these and other objects of the invention may be attained in a novel necktie positioning device which comprises a generally rigid, generally elongated body member which has a first end and a second end. The body member is unmarked with units measurement. The device also comprises a generally rigid sliding member. The members are slidably engaged such that they are relatively movable along a longitudinal path. The sliding member is joined to a generally rigid arm. The arm projects outwardly from the body member and the arm is adapted for insertion in a belt loop.

In many forms of the invention the body member further includes at least one clearly discernible first marking and at least one clearly discernible second marking. The first marking is proximate to the first end, and the second marking is disposed from about one inch to about four inches from the second end.

In many forms of the invention the sliding member engages the body member such that the arm is slidably movable beyond the first end.

In many forms of the invention the device further comprises means for frictionally restraining the members to impede free relative movement therebetween until a person applies sufficient force to overcome the restraint.

In many forms of the invention the body member further includes a plurality of apertures. The apertures are sized to accept fastening means for the prevention of relative movement between the body member and the sliding member. The apertures are located such that the sliding member may be secured continuously relative to the body member.

In some forms of the invention the body member envelopes the sliding member, and the body member includes two pairs of first and second markings, whereby the device is reversible.

BRIEF DESCRIPTION OF THE DRAWING

The invention will be better understood by reference to the accompanying drawing in which.

DESCRIPTION OF THE PREFERRED EMBODIMENT

Figure 1:
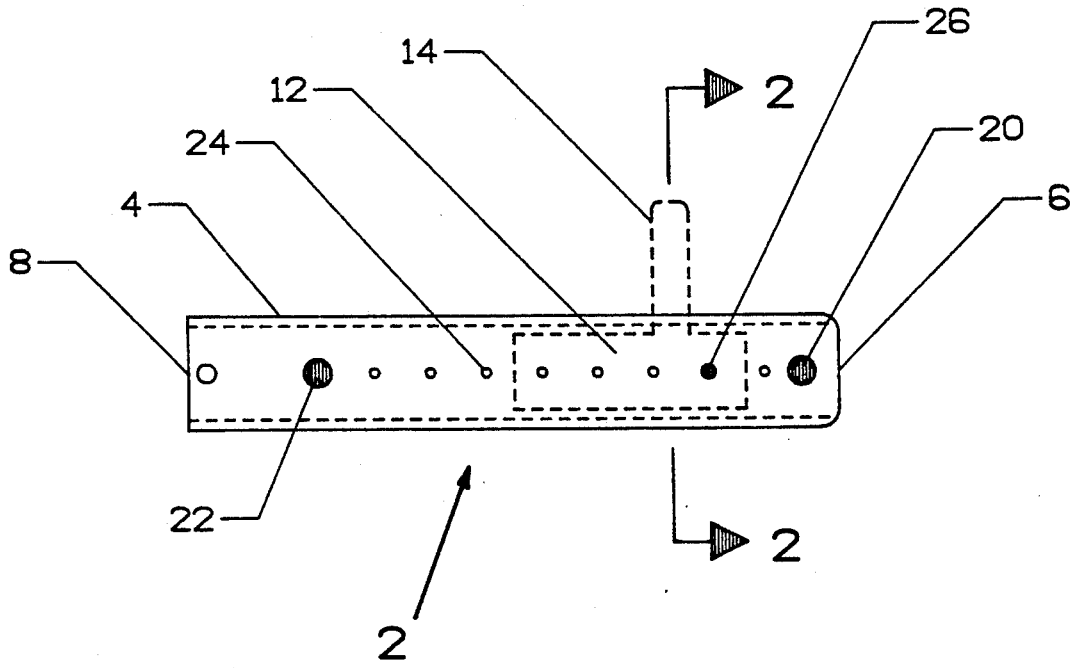
FIG. 1 is a perspective view of one form of the invention.
Figure 2:
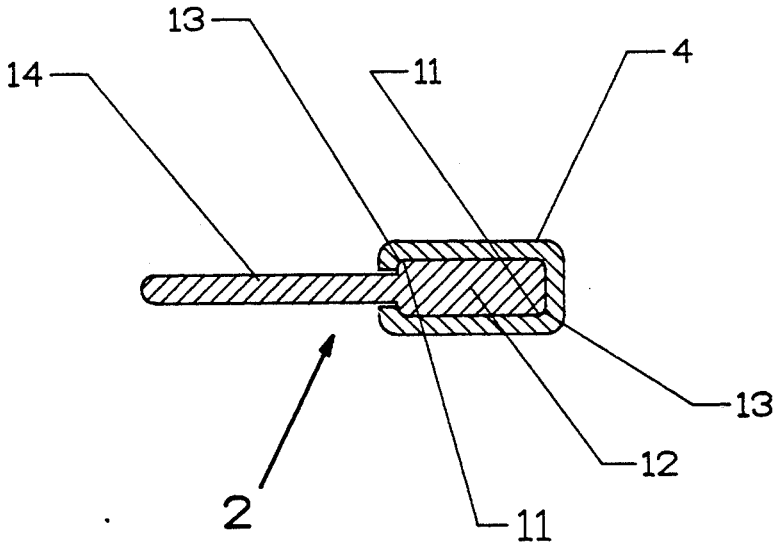
FIG. 2 is a cross-sectional view of the device shown in FIGS. 1 and 3.

Referring first to FIG. 1 and FIG. 2, one embodiment of the necktie positioning device 2 is indicated.

The device 2 comprises a generally rigid, generally elongated body member 4, which has a first end 6 and a second end 8. The length of the body member 4 (between the first end 6 and the second end 8) is preferably about 7".

The body member 4 engages a generally rigid sliding member 12 such that the members 4, 12 are slidably engaged such that the members are relatively movable along a longitudinal path. FIG. 2 shows how the sliding member 12 is envisioned for the present invention. This figure also shows a generally rigid arm 14 which is joined to the sliding member 12. The sliding member 12 is preferably about ¾" wide. The sliding member 12 is preferably of a length (the direction generally parallel to the body member 4) which will allow the arm 14 to move beyond the first end 6. The sliding member 12 is preferably manufactured so that the arm 14 may be positioned at least 2" beyond the first end 6. This property allows the body member 4 to be shorter than it would otherwise have to be and thereby makes the device 2 more compact.

As shown in FIG. 2, the body member 4 preferably envelopes the sliding member 12. The sliding member 12 preferably has external shoulders 11 which cooperate with internal shoulders 13 on the body member 4.

The arm 14 projects outwardly from the body member 4, and preferably forms approximately a right angle with the body member 4. The arm 14 is adapted for insertion in a belt loop 16. This is most preferably accomplished by having the arm 14 sufficiently thin (±⅛") so that it may slide in easily between a belt loop 16 and a belt 18. The arm 14 is also preferably of a width that will also allow the arm 14 to slide in easily into a belt loop 16, preferably about ¼". The arm 14 preferably projects outwardly from the body member 4 a distance of about one inch.

The device 2 may include restraint means sufficient to impede the movement of the sliding member 12 until a person applies adequate force to the sliding member 12 to overcome the restraint. Referring to FIG. 2, if the body member 4 envelopes the sliding member 12 with sufficient precision, then the body member 4 will exert the desired level of restraint on the sliding member 12. Specifically, the external shoulders 11 may be in firm contact with the internal shoulders 13 and thereby create create restraint by friction. A certain amount of restraint is desirable because it facilitates the initial setting of the sliding member 12 relative to the body member 4. If sufficient restraint were not exerted then the sliding member 12 would have to be initially adjusted and then temporarily held in position by other means such as tape, which would be a clumsy approach. Obviously, the restraint should not be so tight that the initial adjusting of the sliding member 12 is unduly difficult.

The body member 4 may include at least one clearly discernible first marking and at least one clearly discernible second marking. The first marking 20 is proximate to the first end 6. The second marking 22 is disposed from about one inch to about four inches from the second end 8. Preferably, it is about four inches. The reason for the range of one to four inches will become more apparent when the methodology of the present invention is explained. Suffice to say at this point that it leaves a convenient distance for the placement of the user's fingers on the body member 4 without obscuring the second marking 22.

Figure 6:
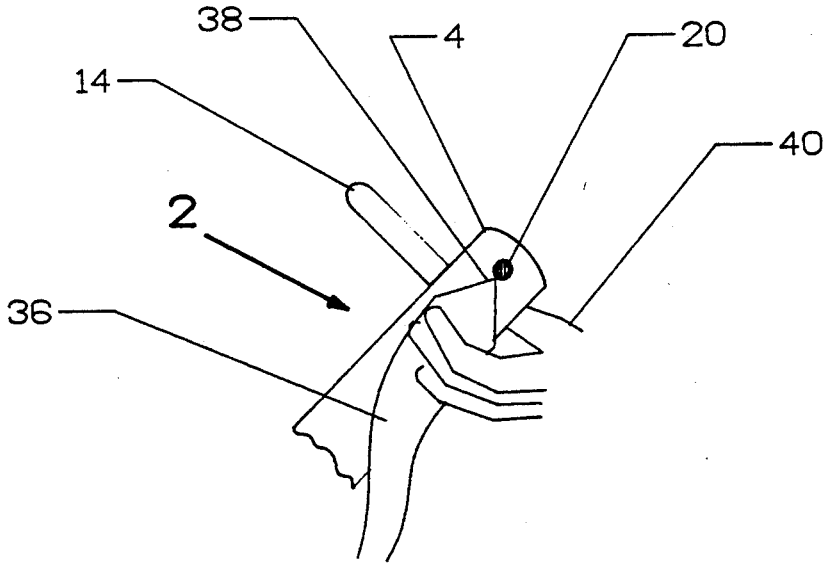
FIG. 6 is a close-up perspective view of the device during use.

The purpose of these markings 20, 22 is to provide an easily identifiable reference point for the user of the device 2 with respect to the tip 38 of the inner flap 36 of his tie (see FIG. 6). A marking offers advantage over a scale in that it is far easier to remember one out of two markings versus having to remember a particular number or symbol out of many. The basic idea, in fact, behind the entire invention is to provide an easily remembered reference point for one's tie (a marking) and let the device 2 do the work of measuring out the tie length. This is accomplished by initially adjusting and setting the sliding member 12 relative to the body member 4, and afterwards one need only remember which of the two markings 20,22 is to be used.

Figure 3:
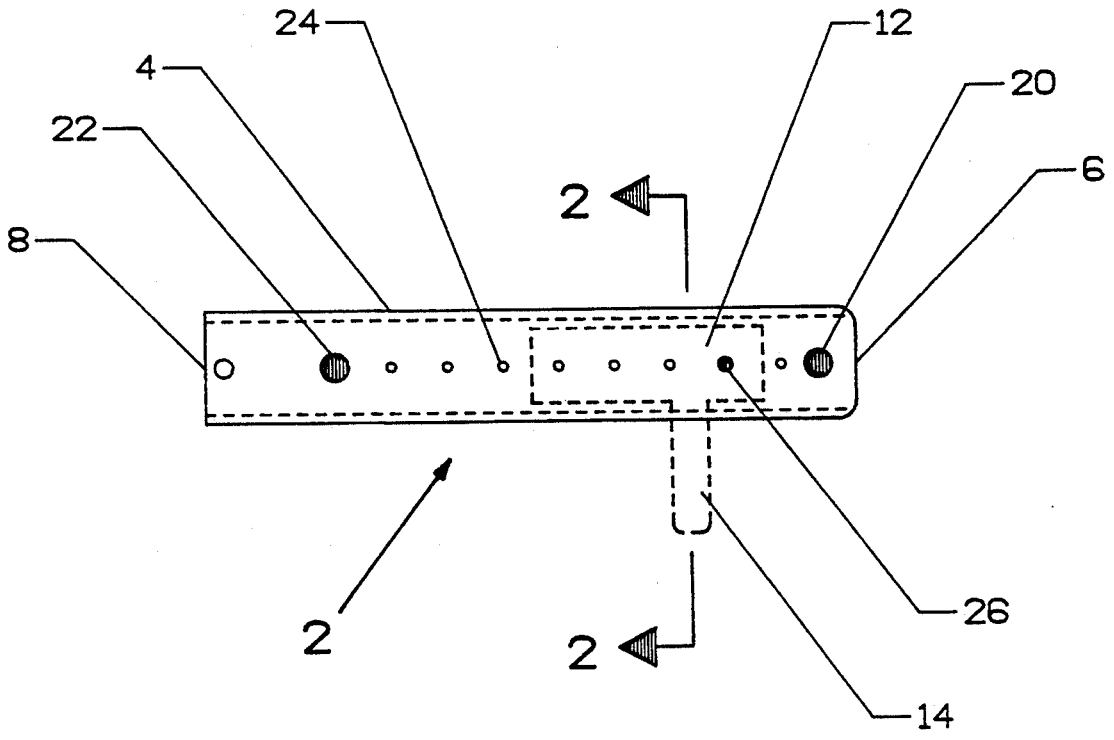
FIG. 3 is a perspective view of the rear of the invention.

As shown in FIG. 2, the body member 4 may envelope the sliding member 12 whereby the device 2 is made reversible. By "reversible" is meant that the device 2 is still usable after being flipped over as shown in FIG. 3. The device 2 is thus usable by either left handed or right handed individuals. This simplifies the ordering and stocking of the device 2 which in turn lowers its price. To achieve full reversibility, the body member 4 preferably includes two pairs of clearly discernible first and second markings (20 and 22 respectively). The first markings 20,20 are preferably located opposite to each other, and the second markings 22,22 are also preferably located opposite to each other.

Figure 4:
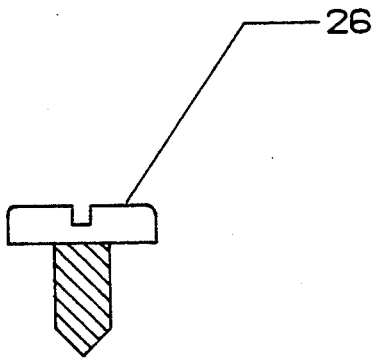
FIG. 4 is a perspective view of one form of fastening means.

As shown in FIGS. 1 and 3, the body member 4 may include a plurality of apertures 24. These apertures 24 would typically be sized to accept fastening means such as a short screw 26 for the prevention of relative movement between the body member 4 and the sliding member 12. Fastening means such as a short screw 26 (shown in FIG. 4) would permanently engage the sliding member 12 to the body member 4. The fastening means would be installed after the initial adjusting of the device 2 had been completed by the user. The apertures 24 are preferably spaced along the body member 4 such that the sliding member 12 may be secured member 4 such that the sliding member 12 may be secured continuously relative to the body member 4.

Figure 5:
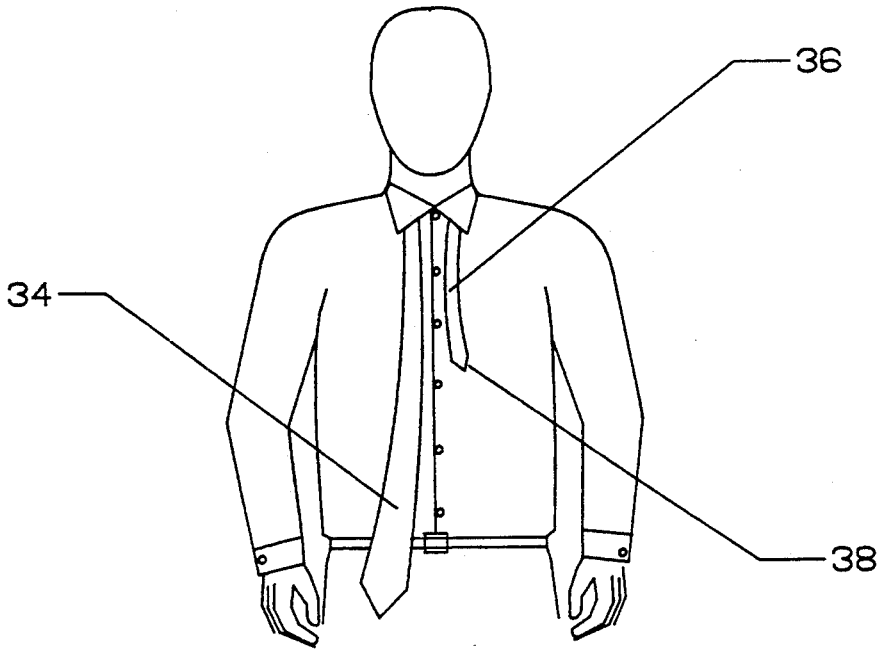
FIG. 5 is a frontal view of a man employing the present invention.

To clarify the use of the present device 2 the following methodology for one embodiment of the invention is presented. Note that all embodiments of the present invention use essentially the same methodology:

1) A tie 34 is placed around the subject's neck as shown in FIG. 5. The inner flap 36 is also shown. It should be noted herein that since most users almost always purchase ties that are of substantially the same length, once the device is set for one of his ties it will subsequently work for most if not all of his other ties as well.

2) As shown in FIG. 6, the subject places the tip 38 of the inner flap 36 onto one of the markings, in this case the first marking 20 is being used.

3) The subject secures the tip 38 against the body member 4 with his fingers 40.

Figure 7:
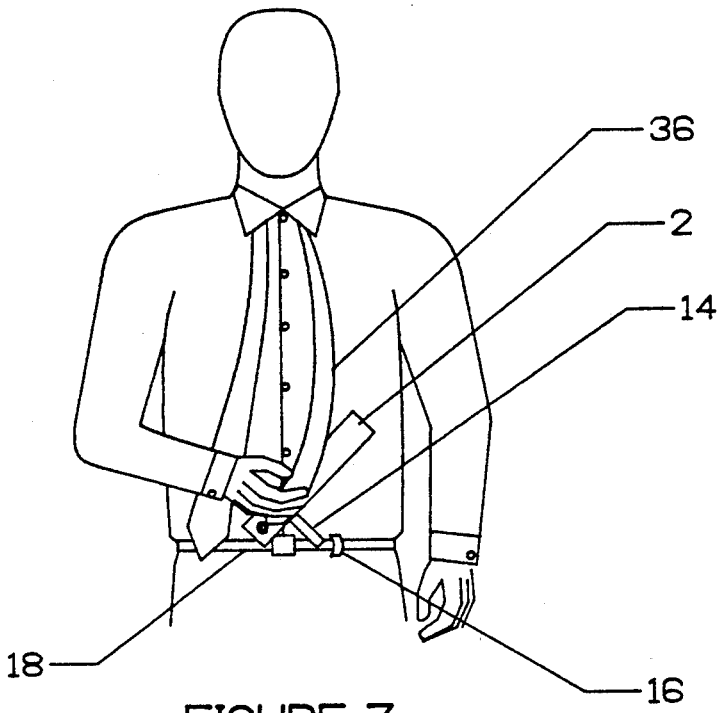
FIGS. 7 and 8 are frontal views of a man employing the present invention.

4) As shown in FIG. 7, the subject positions the device 2 (together with the inner flap 36) as necessary so that the arm 14 may be inserted into a belt loop 16.

Figure 8:
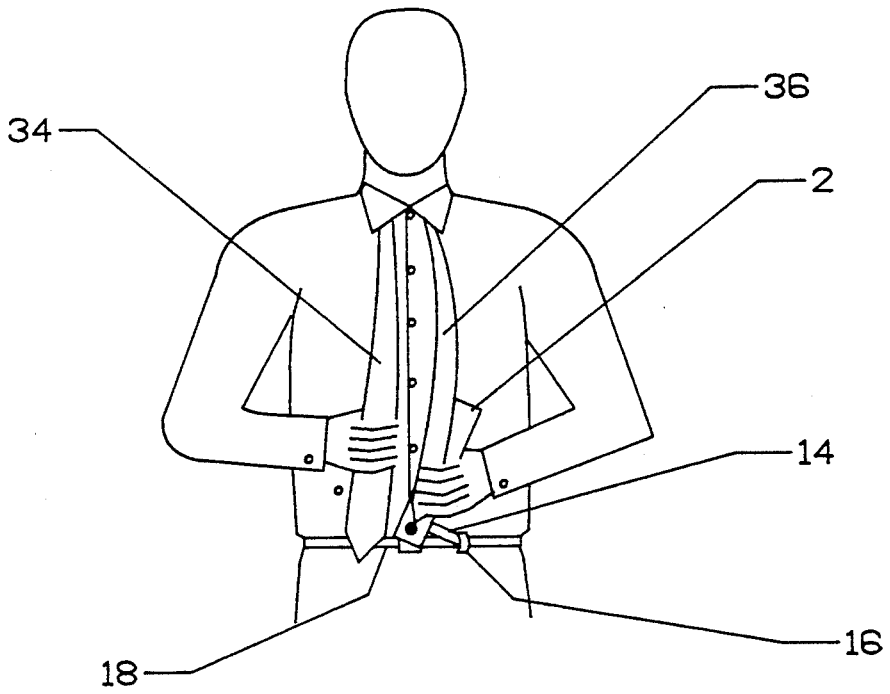

5) As shown in FIG. 8, he inserts the arm 14 of the device 2 into the belt loop 16 and pulls the tie 34 downward until it is substantially taut. The belt loop 16 restrains the arm 14 and thereby sets the tie 34 to the correct length. As shown, he may find it easiest to change hands to accomplish this.

6) He stands up straight and makes sure the tie 34 is reasonably taut. All the while he is securing the inner flap 36 from moving off of the body member 4. This particular step is not shown.

7) He disengages the device 2 from the belt loop 16 and proceeds to put on his tie normally.

Although the above may seem involved, it has only been explained in this detailed manner to fully clarify the methodology. In reality the entire procedure takes no more than 5 or 10 seconds, and since the device positions the necktie almost perfectly every time, no further time is wasted with additional cycles of tying and retying.

Figure 9:
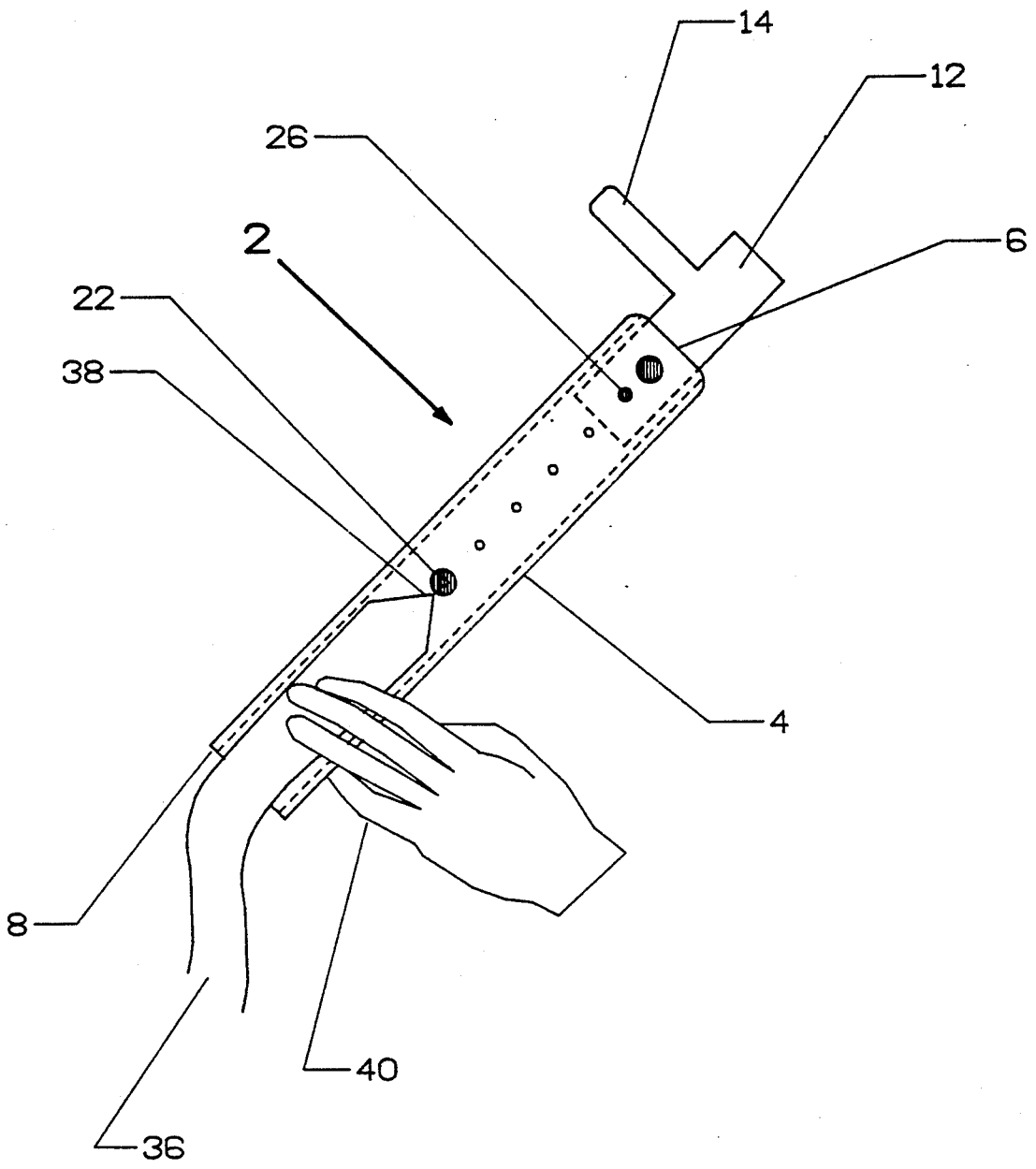
FIG. 9 is another close-up perspective view of the device during use.

For taller men the device 2 would generally be set as indicated in FIG. 9. Taller men will in general utilize the second marking 22. FIG. 9 shows how this might appear to a tall user. FIG. 9 also shows the arm 14 moved beyond the first end 6 as might be required for a taller individual. Also, the distance between the second end 8 and the second marking 22 is preferably about 4" so taller men can easily hold the body member 4 with their fingers 40 without obscuring the second marking 22.

For shorter men the device 2 would generally be set as indicated in FIG. 6. Shorter men will often utilize the first marking 20.

The device 2 essentially eliminates the guesswork of putting on a tie by calibrating a tie to each individual user. The device 2 accomplishes this by making use of certain constants such as:

1) The distance from a man's waistline to his neck,
2) The length of his ties,
3) His neck size, and
4) His preferred method of knotting his tie.

Once the initial adjustments have been made and the fastening means are preventing the sliding member 12 and the body member 4 from relative movement, no further adjustments are required. The device 2 will thenceforward automatically position a tie to its optimum length.

Although inexpensive to manufacture, the device 2 is sturdy and resists breakage. It is also small enough to be easily packed in a suitcase or the like for traveling.

The device 2 may be composed of any material, with plastic being the least expensive, but other materials such as wood could also be used.

It will be readily apparent to a person skilled in the art that a number of variations and modifications can be made without departing from the true spirit of the invention.

I claim:

1. A necktie positioning device comprising:

a generally rigid, generally elongated body member, said body member having a first end and a second end, said body member being unmarked with units of measurement, said body member further comprising at least one first marking and at least one second marking, said first marking being proximate to said first end, said second marking being disposed from about one inch to about four inches from said second end, said markings being clearly discernible from said body member;

a generally rigid sliding member, said sliding member being slidably engaged to said body member such that said member is relatively movable along a longitudinal path of said body member;

said body member envelopes said sliding member;

a generally rigid arm, said arm being joined to said sliding member, said arm projecting outwardly from said body member, said arm being adapted for insertion in a belt loop; said body member includes a plurality of apertures, said apertures being sized to accept fastening means for the prevention of said relative movement, and said apertures being located on said body member so that the said sliding member may be secured at a number of positions relative to said body member.

2. The device as described in claim 1 wherein:

said arm is positioned on said sliding member such that said arm is slidably movable beyond said first end.

3. The device as described in claim 2 wherein:

said device further comprises means for frictionally restraining said members to impede free relative movement between said members until a person applies sufficient force to overcome the restraint.

* * * * *